United States Patent [19]

Pfaff

[11] 4,198,257

[45] Apr. 15, 1980

[54] PROCESS FOR MAKING LAMINATED ROOFING SHINGLES

[76] Inventor: Lloyd A. Pfaff, 16 Fish Haven Rd., Auburndale, Fla. 33823

[21] Appl. No.: 10,369

[22] Filed: Feb. 8, 1979

[51] Int. Cl.[2] ..... B32B 31/00

[52] U.S. Cl. ..... 156/260; 156/512

[58] Field of Search ..... 156/260, 512, 554

[56] References Cited

U.S. PATENT DOCUMENTS

| | | | |
|---|---|---|---|
| 1,829,886 | 11/1931 | Yates | 156/260 |
| 1,852,451 | 4/1932 | Everett | 156/260 |
| 3,998,685 | 12/1976 | Czyzewski | 156/260 |

*Primary Examiner*—Douglas J. Drummond
*Attorney, Agent, or Firm*—Duckworth, Hobby, Allen & Pettis

[57] ABSTRACT

An apparatus cuts a continuous length of saturated felt into wide and narrow sheets and laterally shifts both the first and second sheets in opposite directions into a spaced apart overlying relationship where the center lines of both shifted sheets are aligned with the center line of the uncut felt sheet. Various materials are applied to the exposed surfaces of the upper and lower sheets which are finally laminated together into a single layered sheet. The laminated sheet is then cooled, cut into predetermined lengths and packaged.

12 Claims, 7 Drawing Figures

PROCESS FOR MAKING LAMINATED ROOFING SHINGLES

BACKGROUND OF THE INVENTION

1. Field of the Invention

The present invention relates to the manufacturing of roofing shingles.

2. Description of the Prior Art

A laminated roofing shingle design has recently been developed. The laminated shingle includes a two layer shingle in which a narrow strip of asphalt saturated felt is attached to the exposed edge of the shingle to give the roof of a dwelling an improved appearance by presenting to the viewer's eye a thicker shingle edge.

U.S. Pat. No. 3,998,685 (Czyzewski, et al.) discloses an apparatus and process for making an offset laminated roofing shingle of the type described above. This patent discloses an apparatus for saturating and longitudinally cutting a continuous felt strip into first and second sheets and then laterally shifting the narrower shim sheet into a position below the remaining wider overlying sheet. After the felt sheet has been cut into the first and second sheets and after the narrower sheet has been shifted into alignment with the center line of the wider sheet, both the narrow and wide sheets are no longer aligned with the center line of the processing machinery.

Since all existing roofing shingle manufacturing machinery produces various products one at a time and since non-laminated roofing shingles are maintained on the machinery center line during the entire manufacturing process, the roofing shingle manufacturing machinery must be shut down and certain elements of the machine must be repositioned to manufacture laminated shingles which beyond a certain point do not travel along the center line of the machinery. Making the necessary machinery modifications takes time and results in lost production.

SUMMARY OF THE INVENTION

The present invention contemplates an apparatus and process for making an offest laminated roofing shingle. A continuous length of saturated felt is cut into first and second sheets. The first and second sheets are laterally shifted in opposite directions into a spaced apart overlying relationship where the center lines of both shifted sheets are aligned with the center line of the uncut felt sheet. Various materials are applied to the exposed surfaces of the upper and lower sheets which are finally laminated together into a single layered sheet. The laminated sheet is then cooled, cut into predetermined lengths and packaged.

An important aspect of the present invention is that it permits various types of laminated and non-laminated roofing materials to be manufactured on a single machine without the necessity for disassembling and relocating the processing machinery which is located downstream from the section of the manufacturing machinery which cuts the continuous length of felt into the first and second sheets.

DESCRIPTION OF THE DRAWINGS

The invention is pointed out with particularity in the appended claims. However, other objects and advantages together with the operation of the invention, may be better understood by reference to the following detailed description taken in connection with the following illustrations wherein:

FIGS. *4a*, *4b* and *4c* illustrate the steps by which the first and second sheets produced by cutting the continuous felt strips are maintained in symmetrical alignment with the center line of the uncut felt sheet.

Figures 2, 5:
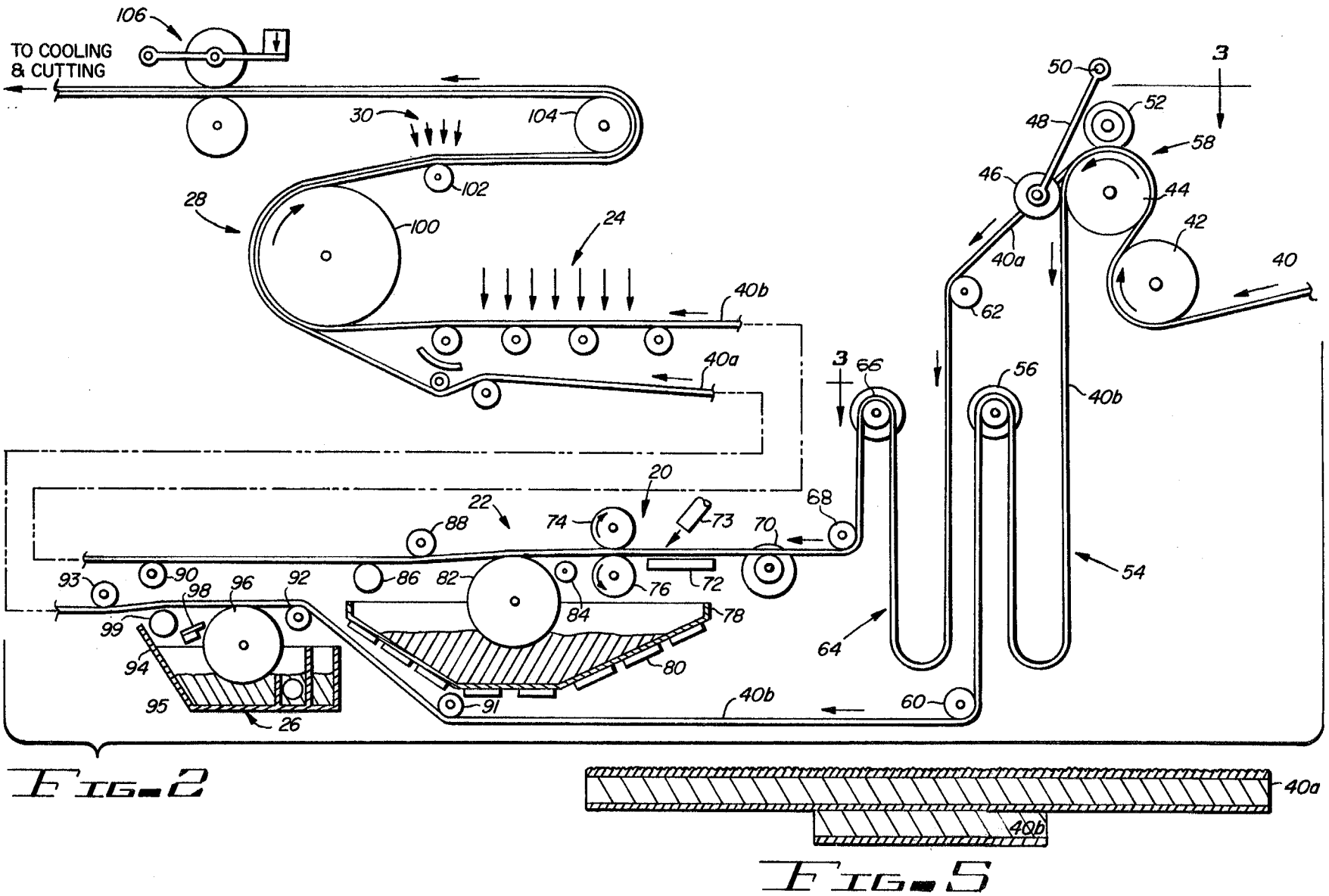
FIG. 2 is a simplified elevational view of a preferred embodiment of the present invention.

FIG. 5 is an end view of the product configuration from cooling station 34.

DESCRIPTION OF THE PREFERRED EMBODIMENT

In order to better illustrate the advantages of the invention and its contributions to the art, a preferred hardward embodiment of the invention will now be described in some detail.

The disclosure contained in U.S. Pat. No. 3,998,685 is relevant to the present invention and for that reason is hereby incorporated by reference.

A continuous roll of felted paper or rag felt having a weight of approximately 11.5 pounds per 1000 square feet and a thickness of seventy mills is wound in a continuous length upon a core which is rotatably suspended on a bracket to permit unwinding of the sheet. This uncut felt sheet is generally 36 inches in width, although any other width can be readily adapted for use with the present invention by simple modifications well known to those skilled in the art. The sheet unwind station for the felt is indicated by reference numeral 10 in FIG. 1.

The process of the present invention will now be described in connection with the flow diagram illustrated in FIG. 1. After the continuous length of felt is unwound from the felt unwind station 10 it is subjected to a saturation step in saturator 12. In general, saturator 12 operates by permitting the lower portion of a series of felt loops to be submerged in a bath of hot liquid asphalt for a period of time sufficient to thoroughly saturate the felt sheet.

The saturated felt sheet is then directed to a slitter 14 which cuts the 36 inch wide felt strip into a first felt strip 28 inches in width and a second felt strip 8 inches in width.

The center line of the top of the first sheet is shifted into alignment with the center line of the uncut felt sheet by top sheet shifter 16. In the preferred embodiment of the invention, top sheet shifter 16 shifts the center line of the top sheet 4 inches in order to properly align it with the center line of the uncut felt sheet.

Figure 4:
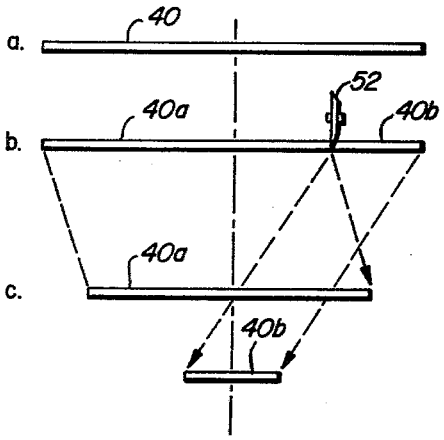

In a similar manner, bottom sheet shifter 18 shifts the center line of the bottom or second sheet 14 inches to bring the center line of the bottom sheet into alignment with the center line of the uncut felt sheet. FIG. 4 clearly illustrates the manner in which the center lines of the top and bottom sheets are shifted to bring them into alignment with the center line of the uncut felt sheet.

After the top and bottom felt sheets are passed through top sheet shifter 16 and bottom sheet shifter 18, both the top and bottom sheets will have been laterally shifted in opposite directions into a spaced apart overlying relationship where the center lines of both shifted sheets are aligned with the center line of the uncut felt sheet.

Figure 1:
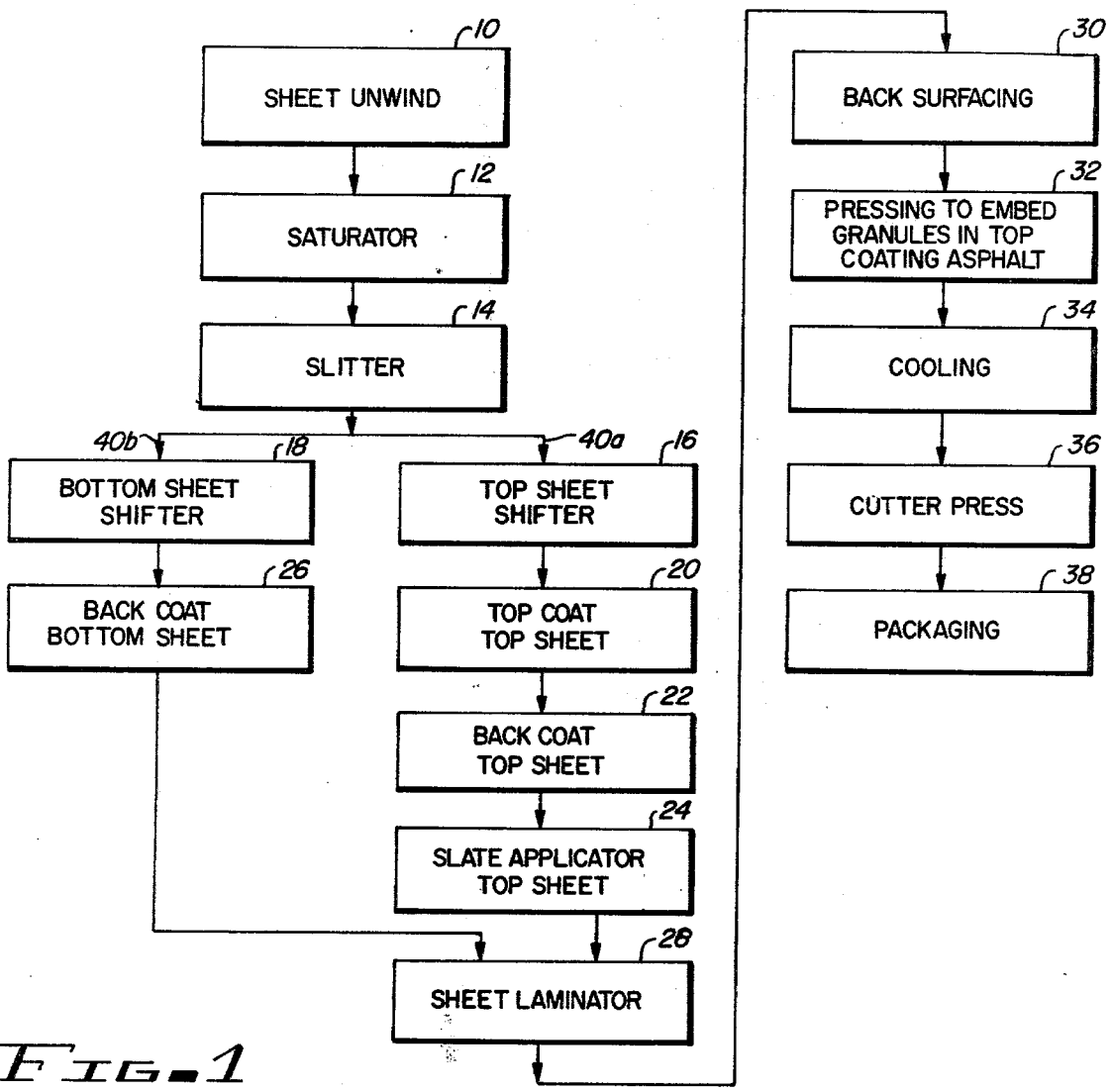
FIG. 1 is a flow diagram depicting the various processing steps required to manufacture laminated roofing shingles in accordance with the present invention.

In a manner well known to those skilled in the art, top coating, back coating and slate application steps are accomplished at selected stations as is indicated by reference numbers 20, 22 and 24 of FIG. 1. Simultaneous with the processing of the top sheet, a back coating is applied to the bottom sheet as passes through station 26.

The overlying, aligned top and bottom sheets are then passed through a sheet laminating station 28 where the two sheets are laminated together into a single sheet.

This laminated sheet is passed through a back surfacing station 30 where fine silica sand or powdered talc is applied to the back surface of the laminated strip to prevent the shingles produced by this process from sticking together after they have been packaged in bundles. The laminated felt strip is then routed to station 32 where imbedded granules are pressed into the top coating of the laminated asphalt sheet. The laminated sheet is then passed through a cooling zone 34 to a shingle cutting press 36 which cuts the laminated sheet into two separate sheets having a double layer around one exposed edge. A conventional packaging apparatus 38 collects and packages the finished roofing singles.

A more detailed description of the structure of the preferred embodiment of the present invention will now be described in connection with FIG. 2. A continuous uncut saturated sheet of felt 40 passes around the periphery of pulling rolls 42 and 44 which are rotated in the direction indicated by the arrows. A pivoted rider roll 46 is coupled to arm 48 which is rotatably suspended about a pivot point 50. Rider roll 46 assists in maintaining the felt strip under tension and in properly guiding the felt through pulling rolls 42 and 44. A bevelled cutting blade 52 cuts the saturated felt sheet 40 into a wide upper sheet **40*a* and a narrow bottom sheet 40*b*. See FIGS. 4*a*, *b* and *c* for an indication of the relative alignment of cutting blade 52 and felt sheet 40**.

Figure 3:
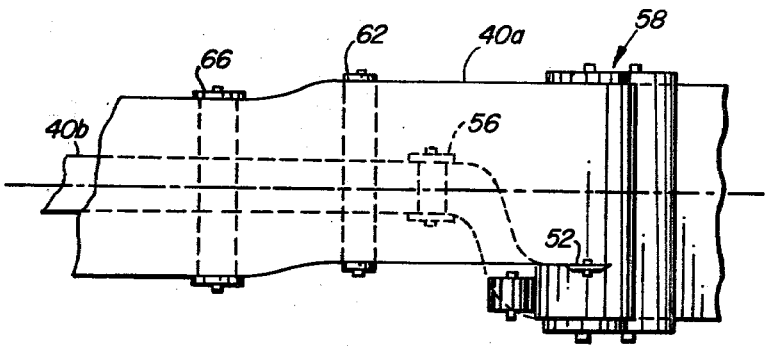
FIG. 3 is a view from above of the cutting and shifting apparatus illustrated in FIG. 2

A first descending loop indicated generally by reference number 54 is formed in bottom sheet **40*b* as it passes downstream from the cutting means described above. Bottom sheet 40*b* then passes over a first flanged roller 56 which includes a center line precisely aligned with the center line of the uncut saturated sheet 40. See FIG. 3 for an indication of the relative alignment of first flanged roller 56 with the multi-element cutting means which is indicated generally by reference numeral 58. Bottom sheet 40*b* passes around the internal periphery of first flanged roller 56 and is then directed to guide roller 60 which reorients bottom sheet 40*b*** into a generally horizontal orientation.

After being discharged from cutting means 58, top sheet **40*a* passes around a guide roller 62 and is then formed into a second descending loop indicated generally by reference numeral 64. Top sheet 40*a* then passes around the interior portion of a second flanged roller 66 which has its center line aligned with the center line of the uncut felt sheet. Top sheet 40*a* then passes around a guide roller 68 and an additional flanged roller 70** to orient the top sheet into a generally horizontal direction to permit further processing.

Referring now to the left hand portion of FIG. 2, top sheet **40*a* is conveyed across the upper surface of a table 72 and then passes between rollers 74 and 76. Roller 74 spreads a coat of hot asphalt discharged over the upper surface of top sheet 40*a* from a hot asphalt dispenser 73 maintained above sheet 40*a*. A plurality of heaters, such as heater 80, maintains the asphalt at an appropriate temperature. Back up roll 76 maintains top sheet 40*a* in contact with application roll 74** during the coating operation.

Top sheet **40*a* then is directed past a back coating roller 82 which applies a coating of hot liquid asphalt to the lower surface of top sheet 40*a*. Doctor roll 84 operates in conjunction with back coating roller 82 to control the thickness of the asphalt coating applied to the lower surface of sheet 40*a*. An additional doctor roll 86 removes any excess coating from the lower surface of sheet 40*a*. Guide and drive rolls 88 and 90 transport sheet 40*a*** in the directions indicated by the arrows.

Bottom sheet **40*b* is transported below top sheet 40*a* by being passed around guide rolls 91, 92 and 93**.

Tank 94 contains a supply of hot liquid asphalt 95. A roll coater 96 is partially immersed in the liquid asphalt and its outer surface contacts the lower surface of the lower strip **40*b* for the purpose of applying an undercoating. Doctor blades 98 and 99 adjust the thickness of the coating on the lower surface of sheet 40*b***.

Sheets **40*a* and 40*b* are directed over a pluraltiy of guide and support rollers. As sheet 40*a* passes station 24, roofing granules are dropped onto the upper surface and become imbedded in the top ashpalt coat. The application of the granules is indicated by the vertically oriented arrows above sheet 40*a*. Sheets 40*a* and 40*b* are maintained in symmetrical alignment with the center line of the uncut felt sheet 40 as they are brought together and routed around the periphery of laminating roll 100. Laminating roll 100 also assists in pressing the granules into the top asphalt coating on the upper surface of sheet 40*a***.

As the laminated sheet passes guide roller 102 (station 30), a back surfacing of the fine silica sand or powdered talc is applied to the exposed surface of the laminated sheet. The laminated sheet is then passed around the periphery of roller 104 which reverses the direction of travel of the laminated sheet. The sheet then continues traveling through a pressing roller assembly 106 which comprises a pair of opposed rollers. This assembly applies forces to the laminated sheet which presses and imbeds the granules into the top asphalt coating. Downstream from pressing roller assembly 106, the laminated strip is passed through a cutter press (station 36) which makes a linear cut down the center of the laminated strip. The two continuous laminated strips are then cut into single shingles of predetermined lengths. FIG. 5 illustrates the product configuration at cooling station 34. Cutter press 36 will split this laminated product in half and cut out individual shingles. These shingles are then packaged at station 38. The apparatus which accomplish the cooling, cutting and packaging steps are well known to those skilled in the art.

Numerous advantages are realized by maintaining the center lines of the upper and lower strips in alignment with the center line of the uncut felt strip. Since both the upper and lower strips are each shifted a predetermined distance which is substantially less than the shift distance required by prior art devices which shift only the lower sheet, it is possible to shift wider sheets without damaging or breaking the shifted felt strips since the magnitude of the shift distance is reduced. Furthermore, since both upper and lower strips are maintained on the center line of the machinery, existing granule and backing application apparatus and granule embeeding and impressing apparatus can be used without modification. The process of the present invention is less time consuming than prior art processes and the apparatus of the present invention does not have to be realigned when it is desired to shift manufacturing operations from unlaminated to laminated products.

It will be apparent to those skilled in the art that the disclosed invention may be modified in numerous ways and may assume many embodiments other than the preferred forms specifically set out and described above. Accordingly, it is intended by the appended claims to cover all such modifications of the invention which fall within the true spirit and scope of the invention.

I claim:

1. In a method of manufacturing roofing shingles from a continuous length of felt comprising the steps of saturating the felt with a bituminous liquid, longitudinally cutting the felt into first and second sheets, applying a continuous surface coating of molten bitumen to both sides of the first sheet, applying a continuous surface coating of molten bitumen to one side of the second sheet and laminating the two adjacent coated sides of the first and second sheets together to form a single layered sheet, wherein the improvement comprises laterally shifting both the first and second sheets in opposite directions into a spaced apart overlying relationship where the center lines of both sheets are aligned with the center line of the uncut felt sheet prior to laminating the first and second sheets together.

2. The method of claim 1 wherein the step of laterally shifting the first and second sheets occurs immediately after the step of longitudinally cutting the felt into first and second sheets.

3. The method of claim 1 wherein the felt is longitudinally cut at a point offset from the center line of the felt.

4. The method of claim 1 wherein the first and second sheets are of unequal width.

5. The method of claim 1 wherein the first sheet is wider than the second sheet and is maintained in a vertical position above the second sheet.

6. The method of claim 5 including the further step of forming a descending loop in the second sheet following the step of longitudinally cutting the felt for the purpose of laterally shifting the center line of the second sheet into alignment with the center line of the uncut felt sheet.

7. The method of claim 6 including the further step of forming a second descending loop following the step of forming the first descending loop for the purpose of laterally shifting the center line of the first sheet into alignment with the center line of the uncut felt sheet.

8. The method of making roofing shingles from an asphalt saturated felt in continuous process from felt unwind to individual roofing shingles comprising the steps of saturating the felt with a bituminous liquid, longitudinally cutting the felt into first and second sheets, laterally shifting both the first and second sheets in opposite directions into a spaced apart overlying relationship where the center lines of both shifted sheets are aligned with the center line of the uncut felt sheet, applying a continuous surface coating of molten bitumen to both sides of the first sheet, applying a continuous surface coating of molten bitumen to one side of the second sheet, applying a coating of granules to one side of the first sheet, laminating the bitumen covered surfaces of the first and second sheets to form a unitary layered sheet with at least one of the sheet being laminated over its full surface area to the other sheet, cutting the layered sheet into pieces having interdigitating tabs, and separating the pieces for packaging.

9. The method of claim 8 in which the step of longitudinally cutting the felt occurs along a longitudinal line offset from the center line of the felt, whereby the two sheets are of unequal width and the first sheet is wider than the second sheet.

10. The method of claim 9 in which the step of shifting one of the sheets places the wider sheet above the narrower sheet.

11. The method of claim 9 in which the step of shifting is followed by the step of coating the lower surface of the wider sheet with a layer of adhesive.

12. The method of claim 11 in which the lower surface coating step is followed by the step of applying an adhesive coat to the upper surface of the wider sheet followed by the step of applying and imbedding granules into the coating on the upper surface.

* * * * *